US005633618A

United States Patent [19]

Chuang

[11] Patent Number: 5,633,618

[45] Date of Patent: May 27, 1997

[54] FUSELESS PLUG WITH SAFETY CIRCUIT BREAKER

[76] Inventor: Wen-Pin Chuang, No. 24, Lane 47, Diing Meei St., Hsing Chu, Taiwan

[21] Appl. No.: 547,476

[22] Filed: Oct. 24, 1995

[51] Int. Cl.[6] ..... H01H 71/16; H01H 71/04; H01H 61/00

[52] U.S. Cl. ..... 337/56; 337/66; 337/79; 337/91

[58] Field of Search ..... 337/91, 56, 66, 337/79, 53, 62, 72

[56] References Cited

U.S. PATENT DOCUMENTS

| | | | |
|---|---|---|---|
| 3,681,730 | 8/1972 | Fortino | 337/92 |
| 4,347,494 | 8/1982 | Krasser | 337/66 |
| 4,814,739 | 3/1989 | Moldovan | 337/68 |
| 5,153,552 | 10/1992 | Krasser | 337/66 |
| 5,248,954 | 9/1993 | Chiang | 337/66 |
| 5,453,725 | 9/1995 | You | 337/68 |
| 5,513,063 | 4/1996 | Wu | 361/105 |
| 5,526,225 | 6/1996 | Wang | 361/643 |

*Primary Examiner*—Leo P. Picard
*Assistant Examiner*—Stephen T. Ryan
*Attorney, Agent, or Firm*—Pro-Techtor International

[57] ABSTRACT

A fuseless plug with an overload safety circuit breaker having a thermal reactive spring leaf and an electric conductive sheet. When in normal use, the thermal reactive spring leaf and the electric conductive sheet are electrically connected by contacting mutually. If overloading or short circuiting occurs, the temperature will rise, while the thermal reactive spring leaf made of an alloy of two kinds of metal material has different coefficients of temperature, so that the spring leaf will be bent outwardly to release the electric conductive sheet to form a broken circuit state and to assure that no disaster such as a fire alarm will occur. After clearing, a push button can be pushed down to force the electric conductive sheet into engagement again with the spring leaf for use.

5 Claims, 5 Drawing Sheets

FUSELESS PLUG WITH SAFETY CIRCUIT BREAKER

BACKGROUND OF THE INVENTION

1. Field of the Invention

The present invention relates to a fuseless plug with safety circuit breaker, wherein a thermal reactive spring leaf automatically senses whether the circuit is overloaded to thereby decide whether it should separate from an electric conductive sheet or continue to engage the electric conductive sheet, thus forming a safety breaker. This breaker is mounted in the plug for the safety of an electric appliance.

2. Description of the Prior Art

Firealarms happen everywhere in the world, and among them, a great lot are induced by undue using or inferior designs of electric appliances. On the other hand, requirement of people upon living standard and safety of products in use is gradually increasing in pursuance of progressing of industrial science and technique. Safety standards and specifications that a product should pass or should have approach gradually to a perfect state. As to the electric appliances, the main switches therefor in an ordinary house are mostly provided with fuses. Sometimes they are fuseless switches, in order that when the electric wires happen to fire, electricity can be forcibly cut off to prevent disaster. However, such safety means is not mounted on an electric product, therefore the circuit of such safety means is broken often when an electric product is burned. We can see evidently that safety of this kind is not perfect.

Afterwards, a safety device such as shown in FIG. 1 is provided, wherein a fuse tube 14 is mounted in a fuse seat 15 between an insertion piece 16 and a conductor 13 in an electric loop, when in normal condition of usage, the fuse tube 14 is electrically contacted; otherwise, when the circuit is overloaded or shorted, a thermal reactive wire 141 in the fuse tube 14 will be burned to be broken due to over high temperature, hence the electric loop will be interupted to form an open state. Such plug having a safety circuit breaker can increase safety of usage of an electric appliance, it is therefore listed in the specification for safety of an electric appliance in the countries of America and Europe. However, in view that such device is interposed between an upper lid 10 and a lower lid 11, so that when the fuse tube 14 is overloaded to become a circuit breaking state, a consumer should screws out the screws 12 to separate the upper lid 10 and the lower lid 11 for changing of the fuse tube 14. This is very troublesome, especially to those ladies unknowing the electronic principles, they don't dare to try to unscrew for fixing, they are afraid of being shocked or unable of reassembling after dismantling, then the plug is supposed to be sent to the factory for fixing. This will be time consuming and money wastful, such disadvantage is also evident and should be improved.

SUMMARY OF THE INVENTION

The inventor of the present invention studied and invents the present invention in view of the above stated inconvenience, thus providing a fuseless plug with safety circuit breaker to increase safety as well as convenience in use.

The principal object of the present invention is to provide a fuseless type safety circuit breaker wherein a thermal reactive spring leaf automatically senses whether the circuit is overloaded to thereby decide whether it should separate from an electric conductive sheet or continue to engage the electric conductive sheet.

The second object of the present invention is to provide a push button on a lid of the plug, so that after the thermal reactive spring leaf is separated from the electric conductive sheet, the push button can be pushed down to contact again the thermal reactive spring leaf and the electric conductive sheet for conducting electricity, and the plug can recover its normal state of use without dismantling.

The present invention will be apparent in its practical structure and functions after reading the detailed description of the preferred embodiments thereof in reference to the accompanying drawings.

DETAILED DESCRIPTION OF THE PREFERRED EMBODIMENT

Figure 1:
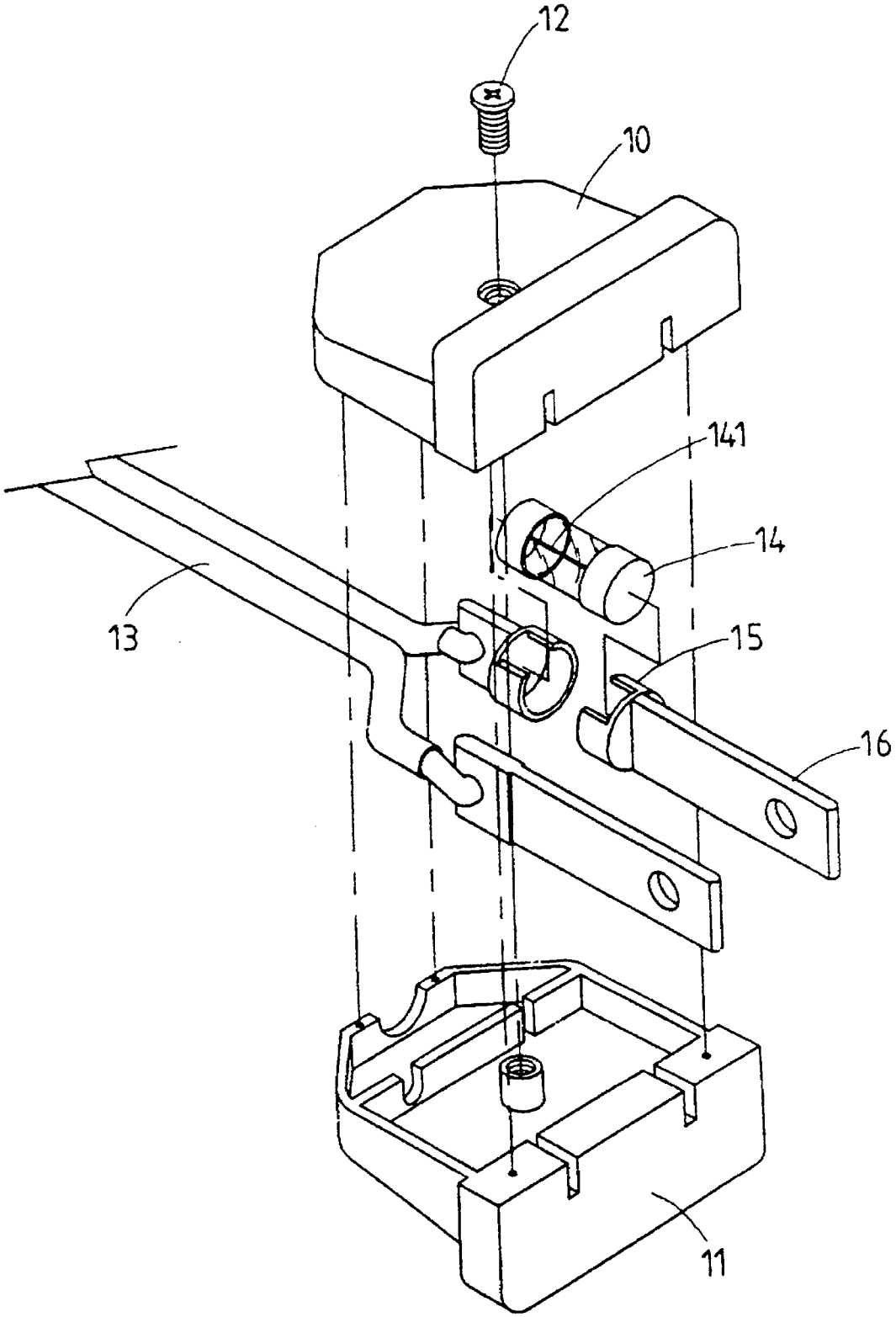
fig 1 (PRIOR ART)
FIG. 1 is an exploded view of a conventional plug structure having a fuse tube.
Figure 2:
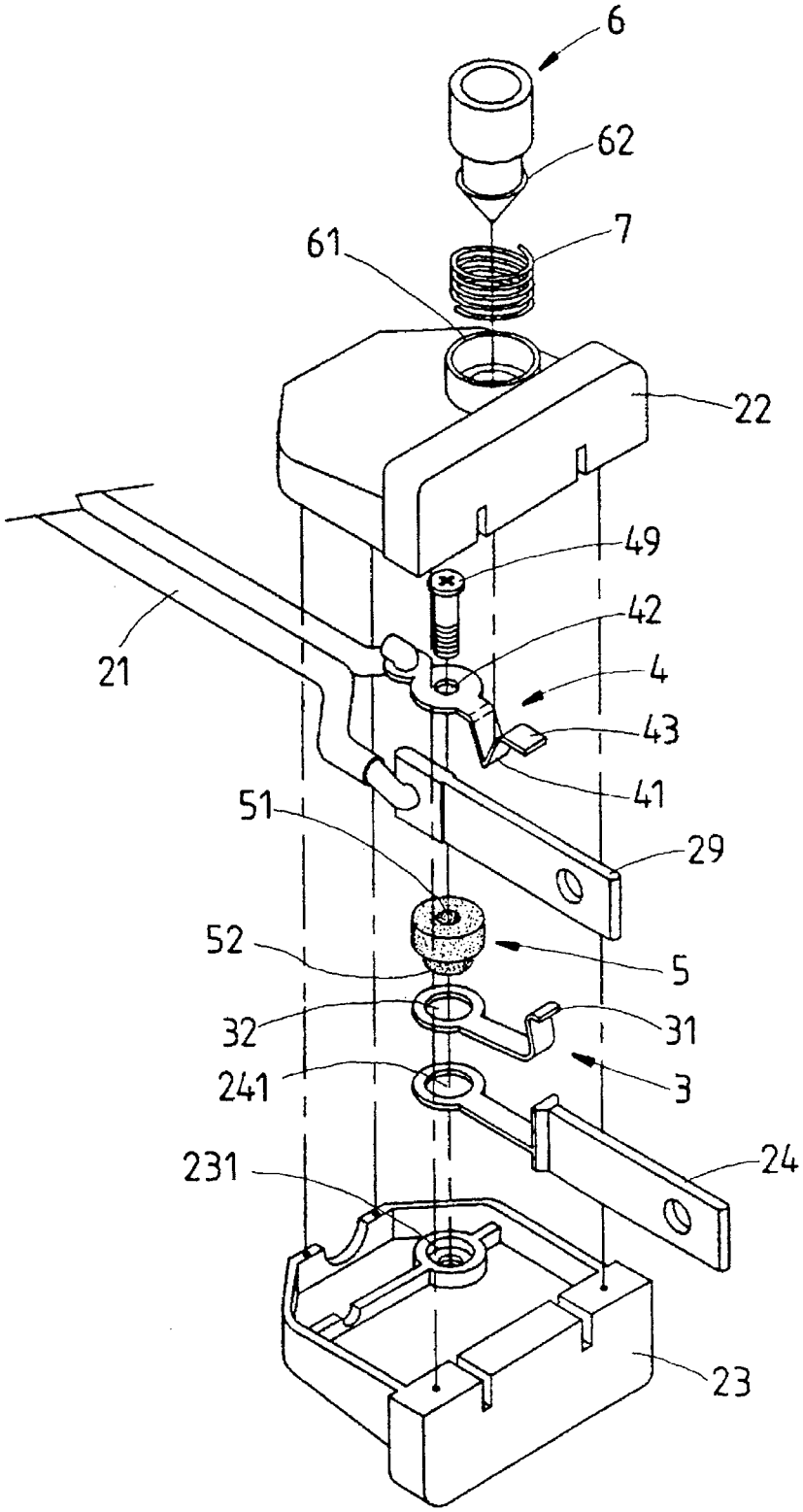
FIG. 2 is an exploded view of the present invention.

Referring to FIG. 2, the fuseless plug with a safety circuit breaker of the present invention comprises mainly a pair of power lines 21, an upper lid 22, a lower lid 23, a pair of insertion pieces 24, 29, a thermal reactive spring leaf 3, an electric conductive sheet 4, an insulator 5, a push button 6 and a spring 7, the upper lid 22 and the lower lid 23 closely engage with each other with the two insertion pieces 24, 29 exposed out of them on one end of the plug, the other end thereof is connected to the power lines 21 which in turn is connected to the main body of an electric appliance, whereof the insertion piece 24 has on its inner end a metal sheet having a locating ring 241, one end of the thermal reactive spring leaf 3 also has a locating ring 32 while the other end thereof is provided with an elastic hook 31; the electric conductive sheet 4 has on one end thereof a sheet ring having a hole 42, the electric conductive sheet 4 is down folded at the middle point thereof to form a V shaped portion 41 for contacting the body of the thermal reactive spring leaf 3 and has a flat sheet portion 43 on the external end thereof; the upper lid 22 is provided with a hole 61 for receiving the push button 6 and the spring 7, the lower end of the push button 6 is provided with an enlarged annular ring 62 to ensure that the push button 6 is positively held in the hole 61 and not to be slipped off.

Assembling of the structure of the present invention is executed with a screw 49 which sequentially locks the hole 42 of the electric conductive sheet 4, the insulator 5, the locating ring 32 and the locating ring 241 onto a locking hole 231 on the lower lid 23, by means of a positioning column 52 provided on the bottom of the insulator 5, the thermal reactive spring leaf 3 and the insertion piece 24 will not contact with the screw 49 to ensure an insulation state between the electric conductive sheet 4 and the thermal reactive spring leaf 3, whereas the thermal reactive spring leaf 3 and the insertion piece 24 are connected with each other; while one end of the electric conductive sheet 4 is connected to one of the power lines 21.

Figure 3:
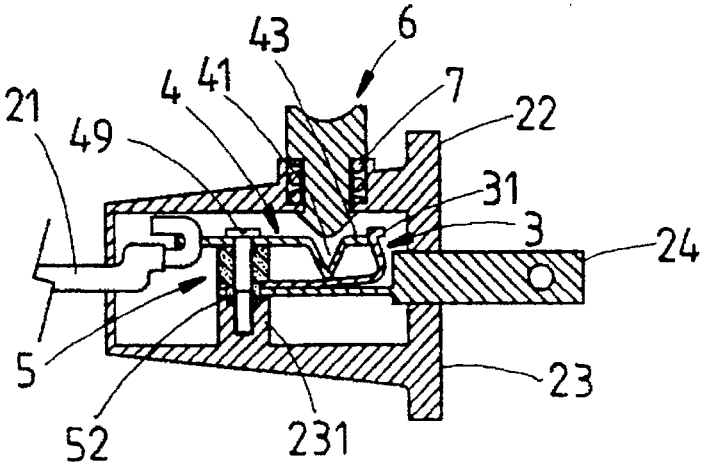
FIG. 3 is a constructional sectional view of the present invention.

Referring to FIG. 3, as stated above, the other end of the thermal reactive spring leaf 3 is provided with an elastic hook 31 which is bended inwardly, hence when assembling is finished, down push of the push button 6 will render the flat sheet portion 43 on the external end of the electric conductive sheet 4 to move down to be engaged in the hook 31 and render the V shape portion 41 to contact the body of the thermal reactive spring leaf 3, i.e., the thermal reactive spring leaf 3 which is separated from the electric conductive sheet 4 originally now contacts the latter, at this moment, the insertion piece 24 is electrically connected with one of the conductors 21.

Figure 4:
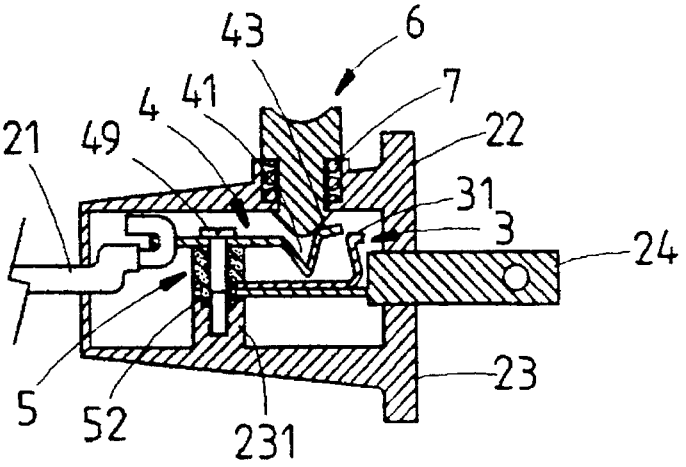
FIG. 4 is a sectional view of the present invention showing the state of circuit breaking.
Figure 5:
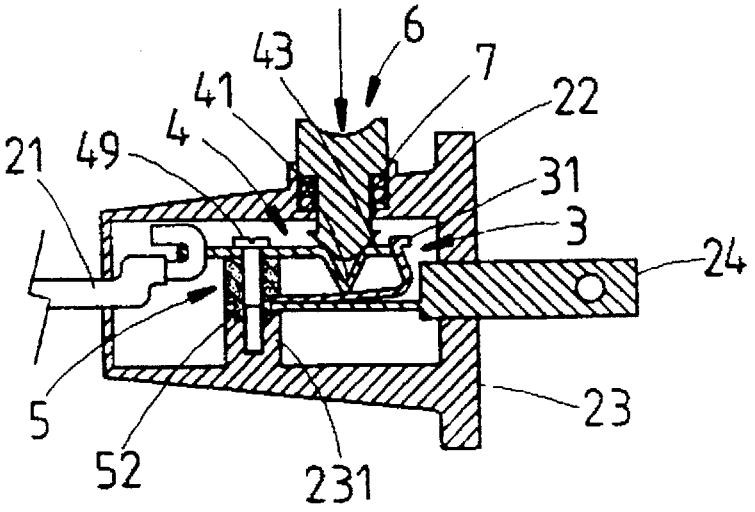
FIG. 5 is a sectional view of the present invention showing recovery of the circuit to function.

If overloading, lengthy using or short circuit of an electric appliance is occurred, temperature on the electric conductive sheet 4 and the thermal reactive spring leaf 3 will rise, while the thermal reactive spring leaf 3 is made of an alloy of two kind of metal material, it has the characteristic as below: the two metal material on the two faces of the alloy has different coefficients of temperature, so that when temperature rises, the thermal reactive spring leaf 3 will have a bending reaction due to such different coefficients. Therefore, if temperature on the thermal reactive spring leaf 3 is overly high, in pursuance of the above stated characteristic, it will be bended outwardly to in turn move outwardly the hook 31, in this way, the flat sheet portion 43 on the electric conductive sheet 4 gets rid of engagement by the hook 31 and bounces upwardly, the electric conductive sheet 4 and the thermal reactive spring leaf 3 will then go into a broken circuit state (as shown in FIG. 4) to assure no disaster such as a fire alarm will occur. After cooling for a while, the thermal reactive spring leaf 3 will recover its original state, and when no undue using is ascertained, the push button 6 can be pushed down again to force the flat sheet portion 43 of the electric conductive sheet 4 into engagement again with the hook 31 to form the closed circuit state (as shown in FIG. 5), power can then be supplied normally, while the push button 6 will be moved upwardly back to its original position by the elastic force of the spring 7.

Figure 6:
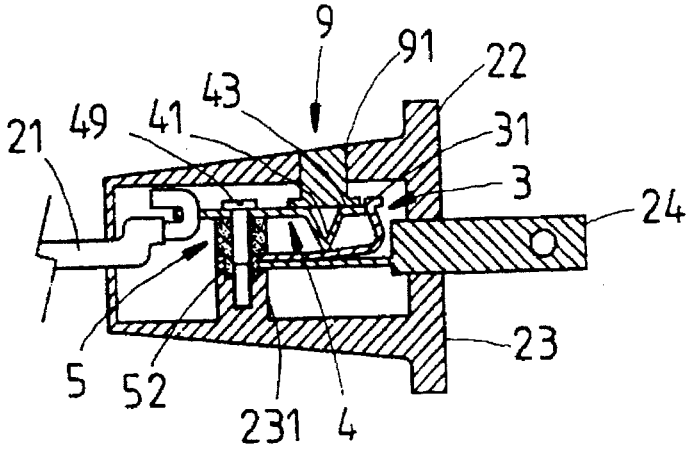
FIG. 6 is a sectional view of another embodiment of the present invention having a push button.
Figure 7:
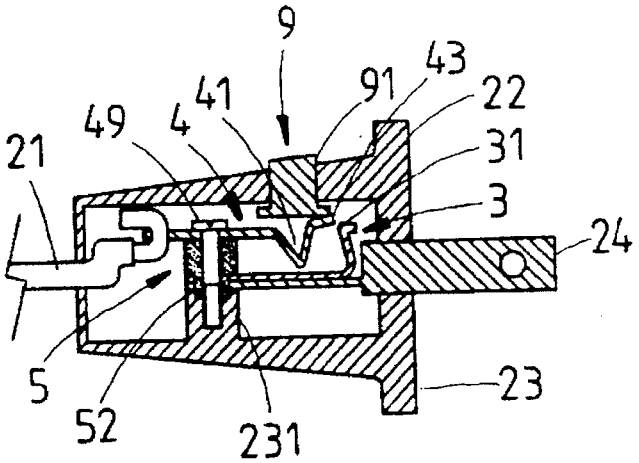
FIG. 7 is a sectional view of the embodiment of FIG. 6 having a push button and showing the state of circuit breaking.

FIG. 6 shows a sectional view of the present invention having another embodiment of push button 9, the push button 9 has a shape of a high hat which is extented from inside of the upper lid 22 through the same, when in a normal state, the push button 9 is immersed in a hole 91 provided on the upper lid 22, i.e., the top surface of the push button 9 is flush with the surface of the upper lid 22, while if the electric conductive sheet 4 is moved upwardly to be in a broken circuit state, the push button 9 will be pushed upwardly to be protruded slightly out of the hole 91, so that a user can recognize a broken circuit state, and can push down the push button 9 after a while.

The practical assembling ways are as stated in the present invention, while various changes may be made in the detailed construction, it is understood that such changes will be within the spirit and scope of the present invention.

Accordingly, the fuseless plug with a safety circuit breaker of the present invention can not only assure safety of use of an electric appliance, but also make convenience of recovery of electric connecting in case of broken circuit without dismantling the plug or exchanging the fuse tube, its value of industry is evident, and it has never existed in the markets, it has therefore novelty and inventiveness.

Having thus described my invention, what I claim as new and desire to be secured by Letters Patent of the United States is:

1. A fuseless plug with safety circuit breaker, comprising a pair of power lines, an upper lid, a lower lid, a first and a second insertion pieces, a thermal reactive spring leaf, an electric conductive sheet, an insulator, a push button end a spring, wherein, a first locating ring on said first insertion piece, a second locating ring on said thermal reactive spring leaf, said insulator and a hole on said electric conductive sheet are sequencially locked by a screw on a locking hole on said lower lid, one end of said electric conductive sheet is connected to one of said power lines, said fuseless plug is characterized in that:

said thermal reactive spring leaf is made of an alloy of two kind of metal material, and is provided with an elastic hook which is bended inwardly; while said electric conductive sheet is down folded at the middle point thereof to form a V shaped portion for contacting the body of said thermal reactive spring leaf, and has on the external end thereof a flat sheet portion which can be engaged in said hook in a normal condition, and render said thermal reactive spring leaf to contact said electric conductive sheet, or contrarily, when temperature of the circuit is raised, said thermal reactive spring leaf will be moved away by virtue of the different temperature coefficents of the material of both side surfaces thereof to allow said electric conductive sheet to be moved upwardly to form a broken circuit; thereafter, a push button can be pushed down to again render said flat sheet portion to contact said thermal reactive spring leaf which now has recovered its original position, so that they can be electrically connected.

2. A fuseless plug with safety circuit breaker as claimed in claim 1, wherein said push button is provided with an enlarged annular ring and is mounted in a hole on said upper lid together with said spring.

3. A fuseless plug with safety circuit breaker as claimed in claim 1, wherein said insulator is provided with a positioning column on the bottom thereof, so that said thermal reactive spring leaf and said locating ring of said first insertion piece will not electrically connect with said electric conductive sheet.

4. A fuseless plug with safety circuit breaker as claimed in claim 1, wherein said thermal reactive spring leaf which is made of an alloy of two kind of metal material can have its width, thickness or material changed optionally to suitably control its value of Ampere or degree of temperature.

5. A fuseless plug with safety circuit breaker as claimed in claim 1, wherein said push button is made to have a shape of a high hat which is extented from inside of said upper lid through the same, so that when said electric conductive sheet is moved upwardly, said push button will be pushed upwardly to be protruded slightly out of said upper lid, this forms a broken circuit state.

* * * * *